US006804921B2

(12) United States Patent
Neylon

(10) Patent No.: US 6,804,921 B2
(45) Date of Patent: Oct. 19, 2004

(54) CAP FOR TUBULAR CONSTRUCTION COMPONENTS AND CONNECTOR

(75) Inventor: Stephen C. Neylon, Akron, OH (US)

(73) Assignee: Associated Materials, Inc., Akron, OH (US)

( * ) Notice: Subject to any disclaimer, the term of this patent is extended or adjusted under 35 U.S.C. 154(b) by 158 days.

(21) Appl. No.: 10/006,225

(22) Filed: Dec. 10, 2001

(65) Prior Publication Data

US 2003/0106273 A1 Jun. 12, 2003

(51) Int. Cl.[7] ..... E04H 12/28

(52) U.S. Cl. ..... 52/244; 52/301; 5/281; 116/173; 138/89; 138/26 R

(58) Field of Search ..... 52/301, 244; 5/281; 116/173; 138/89, 96 R

(56) References Cited

U.S. PATENT DOCUMENTS 5,078,367 A 1/1992 Simpson et al.
5,421,556 A 6/1995 Dodge et al.
5,645,270 A 7/1997 Lawremce
5,755,431 A 5/1998 Williams
5,853,167 A 12/1998 West et al.
5,931,450 A 8/1999 Yoder
6,032,694 A * 3/2000 Wellen et al. ..... 138/89
6,032,695 A * 3/2000 Wellen et al. ..... 138/89
6,561,499 B2 * 5/2003 Lesenskyj et al. ..... 1/1

* cited by examiner

*Primary Examiner*—Carl D. Friedman
*Assistant Examiner*—Steve Varner
(74) *Attorney, Agent, or Firm*—Banner & Witcoff, Ltd.

(57) ABSTRACT

A plastic cap is securable to a tubular fence picket or like construction component by a strong frictional fit when a tubular attachment portion of the cap is pressed into an open end of the construction component. An attachment portion of the cap is tapered to facilitate insertion of the cap, and lines of flexure permit a pair of walls forming the attachment portion to partially collapse without loss of structural integrity in order to allow the attachment portion of the cap to fit tightly inside the corresponding construction component. The lines of flexure include grooves formed in walls of the attachment portion and thinned and rounded corner regions of the attachment portion. Slit-like gaps separate the deformable walls from a decorative top portion of the cap, in order to allow walls of the attachment portion to partially collapse independently of the top portion. In other embodiments, a connector for connecting one structure to another has, at one or both of its opposite ends, an attachment portion of the type included in the cap embodiment.

48 Claims, 5 Drawing Sheets

CAP FOR TUBULAR CONSTRUCTION COMPONENTS AND CONNECTOR

FIELD OF THE INVENTION

The present invention relates generally to construction components, particularly modular fencing components constructed of molded plastic material. More specifically, the invention relates to capping and connecting arrangements for tubular fence pickets, posts and rails, and conduit, as well as other structures.

BACKGROUND OF THE INVENTION

Modular fencing components are known, e.g., in the agricultural and residential industries. For such fencing components, plastics present a beneficial alternative to other materials such as wood. Plastics can be made to take on the desirable external appearance of wood, while exhibiting superior durability and resistance to the elements. In addition, plastic fencing components can be easier and faster to assemble, and they require less maintenance than wood components. Plastic components can also be recycled, and they are less expensive to produce than comparable wood components.

The use of plastics for fencing components is disclosed in Williams U.S. Pat. No. 5,755,431 and West et al. U.S. Pat. No. 5,853,167. In these constructions, open-ended tubular posts are covered by plastic caps that protect and provide a more aesthetically pleasing appearance to the ends of the posts. West et al. disclose such a decorative cover made from a collar that covers the end of a post and an ornamental cap that snaps into the collar.

Caps also have been secured to their corresponding posts by adhesive or mechanical fastening means, such as nails, screws, or rivets. These methods of attachment have several disadvantages. First, they are labor-intensive. In addition, they require the installer to take significant care and effort in their installation. For example, the plastic in the components can be stripped or broken away by mechanical means, and adhesive spills can mar the aesthetic appearance of the fence. Furthermore, adhesives require good surface contact to be effective, and they can contain harsh chemicals that are harmful to the environment and to those applying the adhesives.

Simpson et al. U.S. Pat. No. 5,078,367 and Yoder U.S. Pat. No. 5,931,450 disclose caps that are attached to corresponding tubular posts by a friction fit. With these arrangements, manufacturing tolerances may lead to a friction fit that is too tight or too loose. If the fit is too tight, it may be difficult to install the cap on its corresponding post; if it is too loose, the cap could fall off or be removed inadvertently. Even if the cap fits its corresponding post well, repeated removal may lead to loosening of the cap due to wear, and the cap can still be removed by the elements or by vandals, leaving the end of the post exposed.

An arrangement that alleviates to a significant degree the above-mentioned problems is disclosed in Dodge et al. U.S. Pat. No. 5,421,556. Dodge et al. disclose post caps with a spring tab arrangement that snaps into a hole or groove in a corresponding post. These caps are easy to install and difficult to remove, but the posts must be prepared specially to accept the spring tabs by having holes drilled through their walls, or grooves cut in their inside surfaces.

Lawrence U.S. Pat. No. 5,645,270 discloses a cap that includes a resilient strip that extends between, and protrudes slightly from, opposite sides of an attachment portion of the cap. As the cap is inserted into a corresponding post, the protruded ends of the resilient strip scrape along the inside surfaces of the walls of the post. The curvature of the resilient strip acts as a spring, such that upon an attempt to remove the cap the ends of the strip dig into the inside surfaces of the post walls, making the cap difficult to remove. This design appears to avoid some of the problems of the prior art, but it includes both metal and plastic components that must be combined in a single cap, thus increasing manufacturing and assembly costs.

SUMMARY OF THE INVENTION

In view of the foregoing, it is a principal object of the present invention to provide an improved arrangement for securing a cap on the end of a tubular construction component, e.g., a fence picket, post or rail.

It is a more specific object of the present invention to provide a cap configuration that will provide a sure frictional attachment between the cap and tubular construction component despite potentially loose tolerances of the tubular construction component.

It is a further object of the present invention to provide a cap as aforesaid that may be molded as a single piece.

It is yet another object of the invention to provide a connector configuration that will provide a sure frictional attachment of one structure to another, despite potentially loose tolerances of the parts.

One or more of the above, and/or other, objects are achieved by the various aspects of the invention. In a first aspect, the invention provides a cap for a tubular construction component. The cap has a cover portion for at least partially covering an open end of the tubular construction component and an attachment portion having a line of flexure that allows one of the walls forming the attachment portion to partially collapse when the attachment portion is pressed into the open end of the tubular construction component. The partial collapse of the wall allows for a frictional engagement between the attachment portion and the tubular construction component.

In a second aspect, the present invention provides a kit for assembling a structural component assembly. The kit includes an elongated tubular construction component with an open end and a cap that is insertable into the construction component. The cap has a cover portion for at least partially covering the open end of the construction component and an attachment portion having a line of flexure that allows one of the walls forming the attachment portion to partially collapse when the attachment portion is pressed into the open end of the construction component. The partial collapse of the wall allows for a frictional engagement between the attachment portion and the construction component.

In a third aspect, the present invention provides a structural component assembly having an elongated tubular construction component with a cap inserted into one of its ends. The cap has a cover portion for at least partially covering the end into which it is inserted and an attachment portion having a line of flexure about which one of the walls forming the attachment portion is partially collapsed, creating a frictional engagement between the attachment portion and the construction component.

In a fourth aspect, the present invention resides in a connector for connecting one structure to another. The connector includes an attachment portion comprising a line of flexure which allows a first wall of the attachment portion to partially collapse when the attachment portion is pressed into an open end of a tubular structure, to thereby form a frictional engagement between the attachment portion and the tubular structure. In one embodiment of this fourth aspect, the connector comprises a pair of attachment portions situated at opposite ends of the connector.

The above and other objects, features, and advantages of the present invention will be readily apparent and fully understood from the following detailed description of preferred embodiments, taken in connection with the appended drawings.

DETAILED DESCRIPTION OF THE PREFERRED EMBODIMENTS

Figure 1:
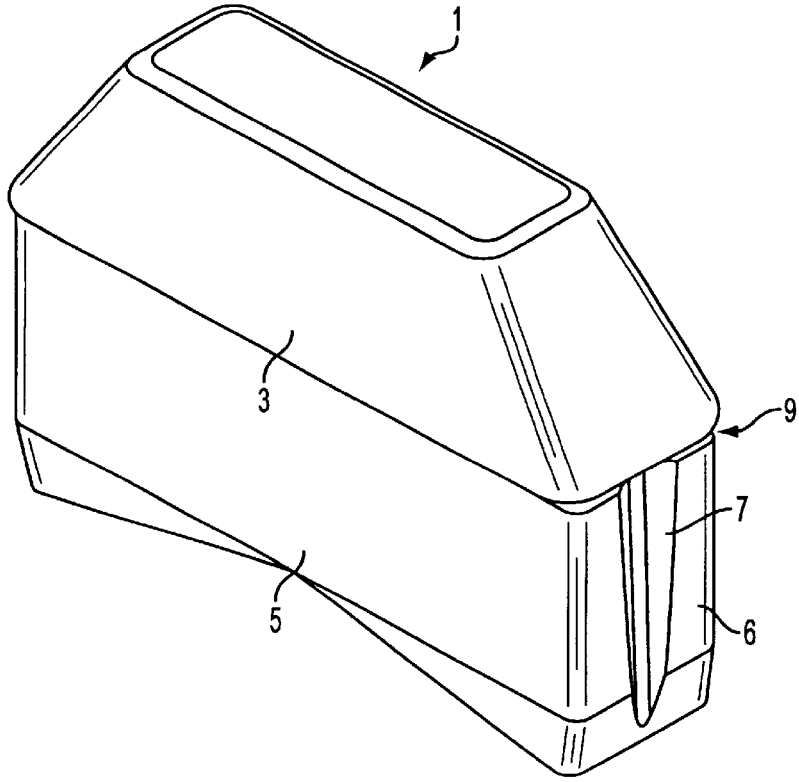
FIG. 1 is a perspective view of a picket cap in accordance with the present invention.

Designated generally by 1 in FIG. 1 is an exemplary cap according to the present invention, for covering an open end of a tubular fence picket. While the invention is described herein primarily in terms of a fence picket, it will be understood that the invention is fully applicable to caps for various other tubular construction components, e.g., tubular fence posts and rails. A preferred material for the cap and associated tubular construction component is plastic, such as polyvinyl chloride (PVC). Other suitable plastic and non-plastic materials may also be used. The cap may be manufactured by injection molding and the tubular component may be extruded. These two components may be supplied separately, as a kit of unassembled parts, or preassembled into a structural component.

Figure 2:
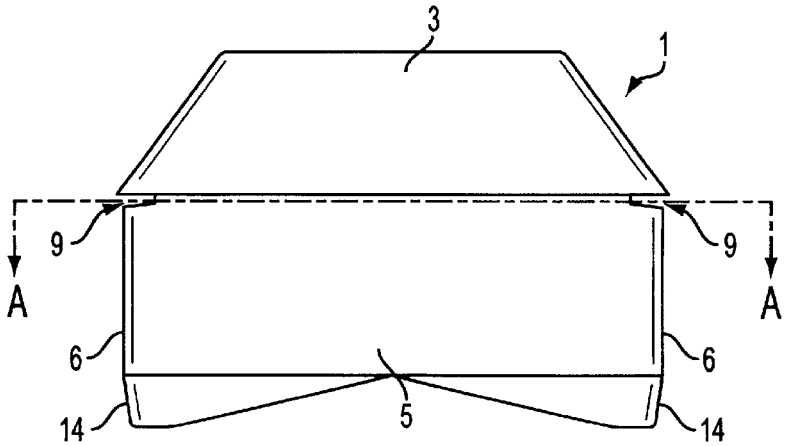
FIG. 2 is a side elevational view of the cap illustrated in FIG. 1.
Figure 3:
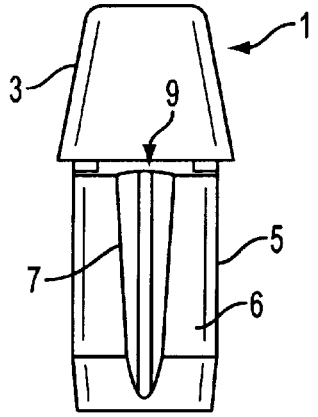
FIG. 3 is an end elevational view of the cap illustrated in FIG. 1.
Figure 4:
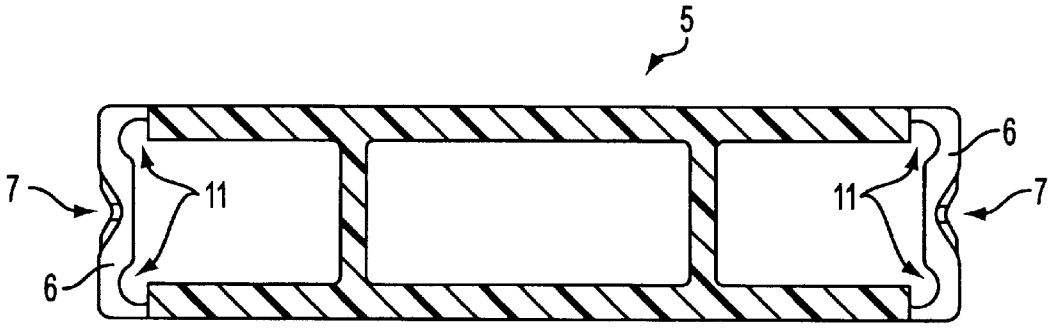
FIG. 4 is a cross-sectional view taken on line A—A in FIG. 2.

As seen in FIGS. 1–3, cap 1 has a decorative generally trapezoidal top section 3 and a bottom attachment section 5 comprising vertical side walls extending downwardly from top section 3 on each side. Walls 6 forming opposite ends of cap 1 have tapering V-grooves 7 formed centrally along their lengths. Slit-like gaps 9 separate walls 6 from top section 3. As seen in FIG. 4, attachment section 5 of cap 1 further includes internal corner regions 11 where a section of the material of the cap is thinned and rounded.

Figure 5:
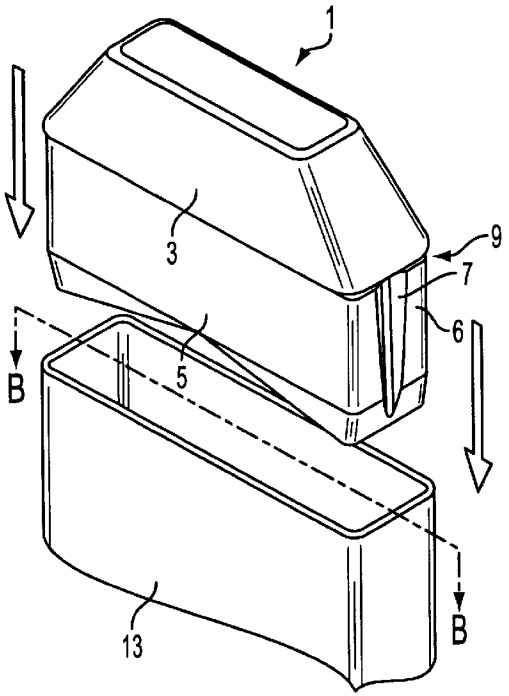
FIG. 5 is a perspective assembly view of the cap illustrated in FIG. 1, together with a corresponding tubular picket.

As indicated in FIG. 5, attachment section 5 of cap 1 is insertable into a corresponding picket 13 with an interference fit. The insertion is facilitated by an inwardly tapered lower section 14 of end walls 6. Preferably the outer peripheral dimensions of the bottom edge of section 5 are slightly smaller than the internal peripheral dimensions of picket 13. At the top of tapered section 14, and extending to gaps 9, the spacing between the outsides of opposite end walls 6 is increased such that it exceeds the corresponding internal dimension of picket 13. In a preferred embodiment, the corresponding internal dimension of picket 13 is exceeded by the width of attachment section 5 (at the top of tapered section 14) by 0.015"–0.065", which range correlates with ordinary wall thickness variations resulting from an extrusion of picket 13. In other words, for a picket section with wall thicknesses at the high end of the tolerance range, the internal dimension will be undersized (relative to the aforementioned width dimension of attachment section 5) by 0.065". For a section of picket 13 with wall thicknesses at the low end of the tolerance range, the internal dimension will be undersized by 0.015".

Picket 13 may be hollow or partially filled with a reinforcing material, such as foamed plastic. Picket 13 has a tubular shape (rectangular in this example) corresponding to the tubular shape of attachment section 5. When cap 1 is pressed into picket 13, walls 6 partially collapse about grooves 7 and corner regions 11, allowing attachment section 5 to fit tightly inside picket 13 with primary points of engagement occurring generally between corner regions 11 and the corresponding corner regions of picket 13. More specifically, and as best seen in FIG. 6A, a point of interference 14 occurs between a flat surface of the picket end wall adjacent the corner thereof, and the outer arcuate surface of corner region 11. This point of engagement will vary depending upon the amount of interference. As the interference is reduced within the tolerance range of the tubular picket, the point of engagement will move toward the corner. Conversely, as the interference is increased, the point of engagement will move away from the corner. This variability of the engagement point results from the pivotal action of corner region 11 as wall 6 partially collapses about groove 7. In the illustrated preferred embodiment, the long walls interfere only lightly (if at all) with the corresponding wall sections of picket 13, and thus these walls do not contribute significantly to the strength of the attachment of cap 1 to picket 13.

Figure 6:
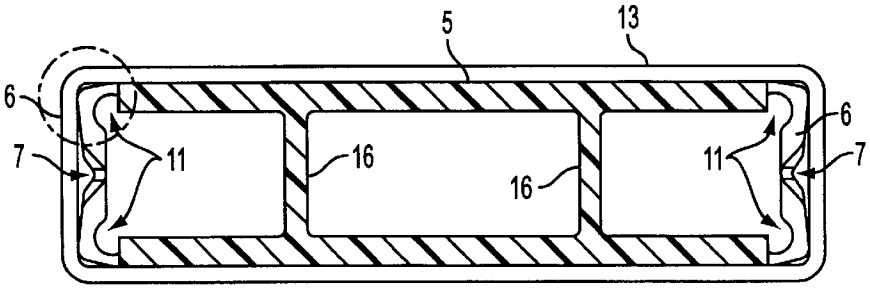
FIG. 6 is a cross-sectional view taken on line B—B in FIG. 5, after the cap has been inserted into the picket.
Figure 6A:
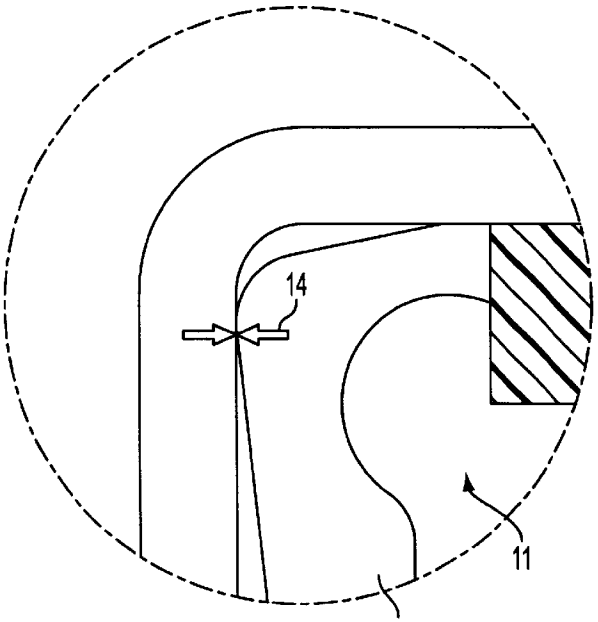
FIG. 6A is a close-up view of a corner portion of the cap/picket assembly illustrated in FIG. 6.

As seen in FIG. 6, the thinned sections of corner regions 11 and groove 7 facilitate an inward folding of wall 6 to partially collapse upon itself (without a loss of structural integrity) and thereby fit tightly inside of picket 13. Internal bracing walls 16 extending perpendicularly between the opposite side walls assist in maintaining overall structural integrity of attachment section 5. Gaps 9 permit the partial collapse of walls 6 to occur independently of (and without damage to) top section 3. This arrangement allows for a strong and sure frictional attachment between cap 1 and picket 13 notwithstanding relatively loose tolerances of the parts (e.g., internal dimensional variation of picket 13 of ±0.025" about a nominal internal dimension of 2.858"), while the mode of attachment between cap 1 and picket 13 remains concealed. In addition to improving the aesthetic appearance of the picket and permitting looser tolerances, the two parts are highly resistant to separation, e.g., by the elements or vandals.

Groove 7 need not have a V-shape or taper. For example, groove 7 could be U-shaped or have a rounded cross-section. More than one groove 7 may be used on each wall 6, depending upon the dimensions of wall 6, and groove 7 could be formed other than centrally in wall 6. Furthermore, the corner regions 11 may have a different shape. For example, the corners of attachment section 5 and picket 13 need not form right angles, and the geometry of the thinned sections of corner regions 11 may differ from that shown in FIGS. 4 and 6. As previously described, the grooves and thinned and rounded corner regions 11 form lines of flexure about which walls of attachment section 5 may partially collapse upon insertion into tubular picket 13. Lines of flexure may be provided by various other means creating lines of weakness relative to the surrounding wall material. In the corners, lines of flexure may be provided by the corner structure without a thinned and rounded section.

The illustrated arrangement of a single centered and tapered groove 7 is preferred for the following reasons. By providing a groove taper that at least roughly matches the internal draft angle (e.g., 2°) of walls 6, a generally uniform thickness of the flex zone within groove 7 may be attained; this will provide more uniform strength characteristics. A single centered groove is preferred (but not essential), as more than one groove, or an offset (non-central) groove, could facilitate a non-uniform flexing at corner regions 11 that could lead to a failure or disengagement of the parts.

While cap 1 and picket 13 are shown with a rectangular cross-sectional shape, and decorative top section 3 has a generally trapezoidal shape, it will be understood that other shapes may be utilized depending upon aesthetic and functional considerations of the intended use. For example, top section 3 could have a pyramid shape, with attachment section 5 and picket 13 having square cross-sections. As a further example, top section 3 could be configured as a sphere, with attachment section 5 and picket 13 having cylindrical shapes.

Grooves 7 and corner regions 11 of cap 1 are preferably integrally molded as part of cap 1, e.g., by injection molding. Alternatively, these features may be machined into a molded or otherwise formed part. Advantageously, no further preparation is required for cap 1 to be able to form a strong friction fit with picket 13 when attachment section 5 is pressed into picket 13. However, walls 6 may be pre-flexed to help ease installation of cap 1 into pickets 13 having wall thicknesses providing an internal spacing between the opposite end walls thereof at the low end of the tolerance range, or to squeeze down attachment section 5 to a size permitting insertion of attachment section 5 into a picket with an internal spacing dimension which approaches or falls below the lower end of the tolerance range. In this case, pre-flexing may also help center cap 1 over picket 13 and ensure a more uniform flexing of walls 6 relative to each other.

Figure 8:
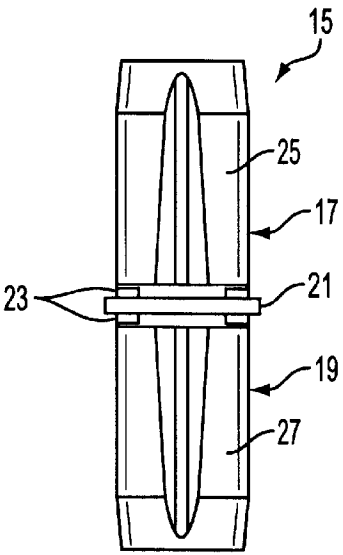
FIG. 8 is an end elevational view of the connector shown in FIG. 7.
Figure 7:
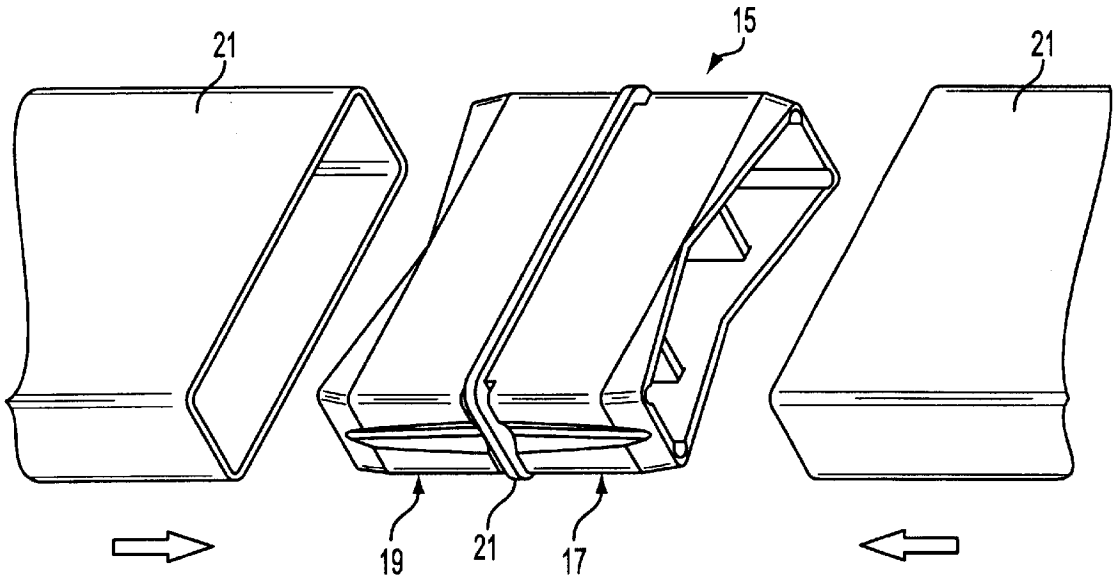
FIG. 7 is an exploded perspective view of a pair of tubular construction components secured together by a connector in accordance with the present invention.
Figure 9:
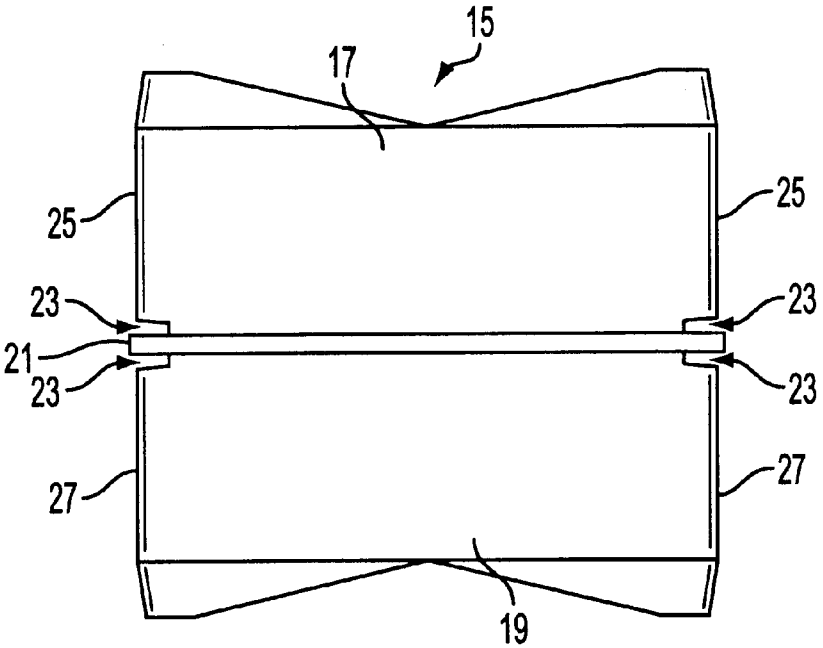
FIG. 9 is a side elevational view of the connector shown in FIG. 7.

Referring now to FIGS. 7–9, a tubular connector 15 in accordance with the present invention comprises a first attachment section 17 that is essentially identical to attachment section 5 of the first (cap) embodiment. In lieu of top (cap) section 3, a second attachment section 19 is provided extending in the opposite direction. With this arrangement, a series of tubular construction components 21 may be secured together, end-to-end, with connector 15, as illustrated in FIG. 7. In addition to fencing applications and the like, connector 15 may find utility where the tubular construction components are lengths of tubing used to form an elongated conduit for power or communication/data lines, e.g., fiber-optic or electrical cabling.

In the illustrated embodiment, the attachment sections 17, 19 are identical to each other, such that connector 15 is symmetrical about a central member 21 serving as a common connecting structure of the two attachment sections. Of course, if it were desired to connect together tubular components of differing section size or shape, connector 15 could be provided with attachment sections differing in size and/or shape from each other.

Similar to the manner in which gaps 9 permit the partial collapse of end walls 6 to occur independently of top section 3 in the cap embodiment of FIGS. 1–6, gaps 23 are preferably provided on opposite sides of common member 21, to thus allow the opposite end walls 25 of attachment section 17 to partially collapse independently of the adjacent pair of opposite end walls 27 of attachment section 19, and vice versa. In the illustrated exemplary embodiment, central member 21 is provided generally in the form of a flat annular ring member to which the sidewalls of the two attachment sections 17, 19 are connected. Central member 21 serves as a stop limiting the inward travel of a tubular component connected on one side of connector 15, such that it does not pass over to on the opposite attachment section. An annular construction of central member 21 will allow pass-through of cable or the like, for conduit applications. Alternatively, central member 21 could be provided as a solid plate serving to physically divide the internal space of connector 15 into separate halves. In either case, a resilient gasket or seal material could be used, if desired, to seal-off the openings provided by gaps 23. Of course, various other connecting structures may be utilized. In a preferred embodiment, connector 15 is, like cap 1, integrally formed as a single piece, e.g., by injection molding.

Figure 10:
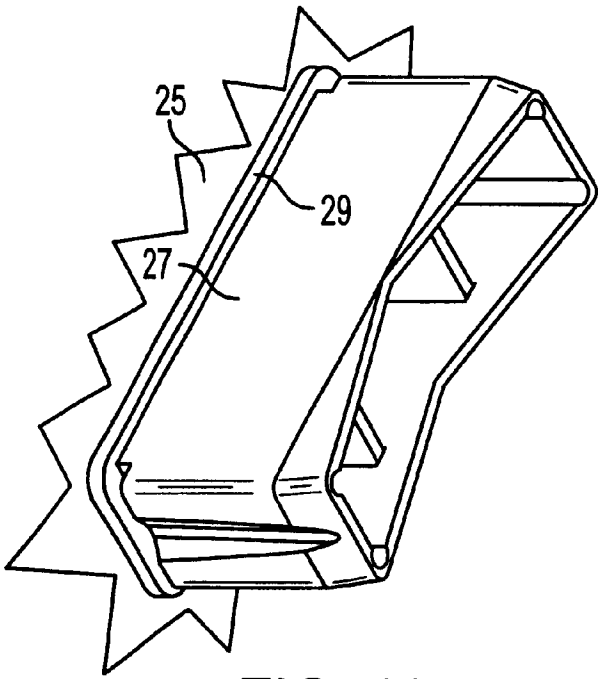
FIG. 10 is a partial perspective view of a second connector embodiment and associated generic structure, in accordance with a further embodiment of the invention.

By providing a connector which is separate from the tubular components 21 to be connected, tubular components 21 can be provided with a uniform tubular section along their entire lengths, thus facilitating production of those components by known extrusion molding processes. In addition, use of a separate connector allows the components to be cut (in the field or at the point of manufacture) to desired lengths without adversely affecting connectibility. Nonetheless, the present invention further contemplates that a variety of structures with diverse purposes (including but not limited to elongated tubular structures) may incorporate one or more attachment sections, like sections 17, 19, allowing that structure to be connected to another component having a mating tubular connecting structure. This is illustrated generally in FIG. 10, wherein a generic structure 25, e.g., an electrical/optical junction box or the like, has attached to and extending from a side thereof an attachment section 27 constructed like attachment sections 17, 19. Attachment section 27 may be integrally molded with structure 25 or formed separately and attached thereto, e.g., by retention in a supporting frame or wall forming a pass-through and abutting with a base member 29 (which may be constructed essentially like central member 21 of the FIGS. 7–9 embodiment).

While the invention has been described with respect to specific examples including presently preferred modes of carrying out the invention, those skilled in the art will appreciate that there are numerous other embodiments, and variations and permutations of the above described exemplary embodiments, that fall within the scope and spirit of the invention as set forth in the appended claims.

What is claimed is:

1. A cap for a tubular structure, comprising:

a cover portion for at least partially covering an open end of the tubular structure; and an attachment portion comprising a line of flexure which allows a first wall of said attachment portion to partially collapse when said attachment portion is pressed into said open end, to thereby form a frictional engagement between said attachment portion and the tubular structure, wherein said line of flexure extends generally centrally along said first wall in an extending direction of the attachment portion.

2. The cap of claim 1, wherein said line of flexure comprises a groove formed in said first wall.

3. The cap of claim 2, wherein said groove is generally V-shaped.

4. The cap of claim 2, wherein said groove is formed in an outside surface of said first wall.

5. The cap of claim 2, wherein a width of said groove tapers along its length.

6. The cap of claim 1, wherein said attachment portion is a generally polygonal tubular portion.

7. The cap of claim 6, wherein said attachment portion is generally rectangular and a second line of flexure extends generally centrally along a second wall opposite said first wall, in an extending direction of the attachment portion.

8. The cap of claim 7, wherein an additional line of flexure is formed by a thinned and rounded section extending along each of four corner regions of said generally rectangular attachment portion.

9. The cap of claim 7, wherein said first and second lines of flexure comprise grooves formed, respectively, in said first and second walls.

10. The cap of claim 7, wherein first and second gaps separate, respectively, said first and second walls from said cover portion, allowing said first and second walls to partially collapse independently of the cover portion.

11. The cap of claim 9, wherein said first and second grooves are generally V-shaped.

12. The cap of claim 11, wherein said first and second grooves are formed, respectively, in outside surfaces of said first and second walls.

13. The cap of claim 12, wherein a width of each of said first and second grooves tapers along its length.

14. A cap for a tubular structure, comprising:

a cover portion for at least partially covering an open end of the tubular structure; and an attachment portion comprising a line of flexure which allows a first wall of said attachment portion to partially collapse when said attachment portion is pressed into said open end, to thereby form a frictional engagement between said attachment portion and the tubular structure, wherein a second line of flexure is formed by a thinned and rounded section extending along a corner region at which a second wall of said attachment portion is connected to said first wall.

15. The cap of claim 14, wherein a third line of flexure is formed by a thinned and rounded section extending along a second corner region at which a third wall of said attachment portion is connected to said first wall.

16. A cap for a tubular structure, comprising:

a cover portion for at least partially covering an open end of the tubular structure; and an attachment portion comprising a line of flexure which allows a first wall of said attachment portion to partially collapse when said attachment portion is pressed into said open end, to thereby form a frictional engagement between said attachment portion and the tubular structure, wherein a gap separates said first wall from said cover portion, allowing said first wall to partially collapse independently of the cover portion.

17. A kit for assembling a structural component assembly, comprising:

an elongated tubular structure having an open end; and a cap insertable into said elongated tubular structure, said cap comprising:

a cover portion for at least partially covering said open end; and an attachment portion having a line of flexure which allows a first wall of said attachment portion to partially collapse when said attachment portion is pressed into said open end, to thereby create a frictional engagement between said attachment portion and the elongated tubular structure, wherein said line of flexure extends generally centrally along said first wall in extending direction of the attachment portion.

18. The kit of claim 11, wherein said line of flexure comprises a groove formed in said first wall.

19. The kit of claim 18, wherein said groove is generally V-shaped.

20. The kit of claim 18, wherein said groove is formed in an outside surface of said first wall.

21. The kit of claim 18, wherein a width of said groove tapers along its length.

22. The kit of claim 11, wherein said attachment portion is a generally polygonal tubular portion.

23. The kit of claim 22, wherein said attachment portion is generally rectangular and a second line of flexure extends generally centrally along a second wall opposite said first wall, in an extending direction of the attachment portion.

24. The kit of claim 23, wherein first and second gaps separate, respectively, said first and second walls from said cover portion, allowing said first and second walls to partially collapse independently of the cover portion.

25. The kit of claim 23, wherein an additional line of flexure is formed by a thinned and rounded section extending along each of four corner regions of said generally rectangular attachment portion.

26. The kit of claim 23, wherein said first and second lines of flexure comprise grooves formed, respectively, in said first and second walls.

27. The kit of claim 26, wherein said first and second grooves are generally V-shaped.

28. The kit of claim 27, wherein said first and second grooves are formed, respectively, in outside surfaces of said first and second walls.

29. The kit of claim 28, wherein a width of each of said first and second grooves tapers along its length.

30. A kit for assembling a structural component assembly, comprising:

an elongated tubular structure having an open end; and a cap insertable into said elongated tubular structure, said cap comprising:

a cover portion for at least partially covering said open end; and an attachment portion having a line of flexure which allows a first wall of said attachment portion to partially collapse when said attachment portion is pressed into said open end, to thereby create a frictional engagement between said attachment portion and the elongated tubular structure, wherein a second line of flexure is formed by a thinned and rounded section extending along a corner region at which a second wall of said attachment portion is connected to said first wall.

31. The kit of claim 30, wherein a third line of flexure is formed by a thinned and rounded section extending along a second corner region at which a third wall of said attachment portion is connected to said first wall.

32. A kit for assembling a structural component assembly, comprising:

an elongated tubular structure having an open end; and a cap insertable into said elongated tubular structure, said cap comprising:

a cover portion for at least partially covering said open end; and an attachment portion having a line of flexure which allows a first wall of said attachment portion to partially collapse when said attachment portion is pressed into said open end, to thereby create a frictional engagement between said attachment portion and the elongated tubular structure, wherein a gap separates said first wall from said cover portion, allowing said first wall to partially collapse independently of the cover portion.

33. A structural component assembly, comprising:

an elongated tubular structure; and a cap inserted into an end of the elongated tubular structure, wherein said cap comprises:

a cover portion for at least partially covering said end; and an attachment portion having a line of flexure about which a first wall of said attachment portion is partially collapsed, to thereby create a frictional engagement between said attachment portion and the elongated tubular structure, wherein a second line of flexure is formed by a thinned and rounded section extending along a corner region at which a second wall of said attachment portion is connected to said first wall.

34. The structural component assembly of claim 33, wherein a third line of flexure is formed by a thinned and rounded section extending along a second corner region at which a third wall of attachment portion is connected to said first wall.

35. A structural component assembly, comprising:

an elongated tubular structure; and a cap inserted into an end of the elongated tubular structure, wherein said cap comprises:

a cover portion for at least partially covering said end; and an attachment portion having a line of flexure about which a first wall of said attachment portion is partially collapsed, to thereby create a frictional engagement between said attachment portion and the elongated tubular structure, wherein said line of flexure extends generally centrally along said first wall in an extending direction of the attachment portion.

36. The structural component assembly of claim 35, wherein said line of flexure comprises a groove formed in said first wall.

37. The structural component assembly of claim 36, wherein said groove is generally V-shaped.

38. The structural component assembly of claim 36, wherein said groove is formed in an outside surface of said first wall.

39. The structural component assembly of claim 36, wherein a width of said groove tapers along its length.

40. The structural component assembly of claim 35, wherein said attachment portion is a generally polygonal tubular portion.

41. The structural component assembly of claim 40, wherein said attachment portion is generally rectangular and a second line of flexure extends generally centrally along a second wall opposite said first wall, in an extending direction of the attachment portion.

42. The structural component assembly of claim 41, wherein first and second gaps separate, respectively, said first and second walls from said cover portion, said first and second walls being partially collapsed independently of the cover portion.

43. The structural component assembly of claim 41, wherein an additional line of flexure is formed by a thinned and rounded section extending along each of four corner regions of said generally rectangular attachment portion.

44. The structural component assembly of claim 41, wherein said first and second lines of flexure comprise grooves formed, respectively, in said first and second walls.

45. The structural component assembly of claim 44, wherein said first and second grooves are generally V-shaped.

46. The structural component assembly of claim 45, wherein said first and second grooves are formed, respectively, in outside surfaces of said first and second walls.

47. The structural component assembly of claim 46, wherein a width of each of said first an second grooves tapers along its length.

48. A structural component assembly, comprising:

an elongated tubular structure; and a cap inserted into an end of the elongated tubular structure, wherein said cap comprises:

a cover portion for at least partially covering said end; and an attachment portion having a line of flexure about which a first wall of said attachment portion is partially collapsed, to thereby create a frictional engagement between said attachment portion and the elongated tubular structure, wherein a gap separates said first wall from said cover portion, said first wall being partially collapsed independently of the cover portion.

* * * * *